US008759648B2

(12) United States Patent
Deering et al.

(10) Patent No.: US 8,759,648 B2
(45) Date of Patent: Jun. 24, 2014

(54) VERTICAL SIDES BANJO TONE RING AND METHODS

(75) Inventors: Charles G. Deering, El Cajon, CA (US); Jens H. Kruger, North Wilkesboro, NC (US); Philip Zanon, North Wilkesboro, NC (US)

(73) Assignee: Deering Banjo Co., Inc., Spring Valley, CA (US)

( * ) Notice: Subject to any disclaimer, the term of this patent is extended or adjusted under 35 U.S.C. 154(b) by 97 days.

(21) Appl. No.: 13/502,064

(22) PCT Filed: Oct. 13, 2009

(86) PCT No.: PCT/US2009/005585

§ 371 (c)(1),
(2), (4) Date: May 22, 2012

(87) PCT Pub. No.: WO2011/046531

PCT Pub. Date: Apr. 21, 2011

(65) Prior Publication Data

US 2012/0222537 A1 Sep. 6, 2012

(51) Int. Cl.
*G10D 1/10* (2006.01)

(52) U.S. Cl.
CPC ..... *G10D 1/10* (2013.01)
USPC ..... 84/269; 84/270

(58) Field of Classification Search
CPC ..... G10D 1/10
USPC ..... 84/270, 269; 72/71
See application file for complete search history.

(56) References Cited

U.S. PATENT DOCUMENTS

| | | | | | |
|---|---|---|---|---|---|
| 66,810 | A | * | 7/1867 | Dobson | 84/271 |
| 443,159 | A | * | 12/1890 | Bradbury | 84/269 |
| 529,514 | A | * | 11/1894 | Andres | 84/272 |
| 542,165 | A | * | 7/1895 | Libby | 84/269 |
| 553,653 | A | * | 1/1896 | Merrill | 84/269 |
| 1,334,631 | A | * | 3/1920 | Piazza | 84/270 |
| 1,337,041 | A | * | 4/1920 | Cetta | 84/269 |
| 1,339,318 | A | * | 5/1920 | Carlucci | 84/269 |
| 1,348,652 | A | * | 8/1920 | Lange | 84/270 |
| 1,371,760 | A | * | 3/1921 | Grover | 84/269 |
| 1,405,771 | A | * | 2/1922 | Favilla | 84/270 |
| 1,409,078 | A | * | 3/1922 | Carlucci | 84/269 |
| 1,424,296 | A | * | 8/1922 | Gardie | 84/270 |
| 1,437,379 | A | * | 11/1922 | Kirk | 84/269 |
| 1,596,703 | A | * | 8/1926 | Wiltsie | 84/271 |
| 1,602,409 | A | * | 10/1926 | Grover | 84/269 |
| 1,603,380 | A | * | 10/1926 | Favilla | 84/269 |
| 1,704,323 | A | * | 3/1929 | Horton | 84/269 |
| 1,704,391 | A | * | 3/1929 | Lange | 84/269 |
| 1,710,930 | A | * | 4/1929 | Klaus | 29/894.353 |
| 1,724,629 | A | * | 8/1929 | Williamson | 84/269 |
| 1,760,789 | A | * | 5/1930 | Sperduti | 84/269 |
| 1,849,091 | A | * | 3/1932 | Hunter | 84/270 |
| 1,881,229 | A | * | 10/1932 | Young | 84/269 |

(Continued)

*Primary Examiner* — Robert W Horn
(74) *Attorney, Agent, or Firm* — Richard D. Clarke

(57) ABSTRACT

The present invention is a banjo tone ring with vertical sides (30) as opposed to the angled design of conventional banjo tone rings (120). The ring (30) of the present invention has specific height (h) to width (w) or thickness ratios and is within specific weight ranges for improved performance It vibrates much freer and thus raises the quality of musical tones from the banjo (10) to much higher aesthetic levels. Other embodiments also modify the musical tones for different sounds. Several novel embodiments of manufacturing methods are also described.

10 Claims, 3 Drawing Sheets

(56) References Cited

U.S. PATENT DOCUMENTS

| | | | | | |
|---|---|---|---|---|---|
| 1,887,291 | A | * | 11/1932 | Day | 84/269 |
| 2,469,643 | A | * | 5/1949 | Handloser | 84/269 |
| 3,203,296 | A | * | 8/1965 | Simon | 84/269 |
| 3,921,492 | A | * | 11/1975 | Stelling | 84/269 |
| 4,060,018 | A | * | 11/1977 | Gilbrech | 84/269 |
| 4,361,021 | A | * | 11/1982 | McVay et al. | 72/71 |
| 4,483,234 | A | * | 11/1984 | Snavely | 84/291 |
| 4,606,105 | A | * | 8/1986 | Snavely | 29/896.22 |
| 5,845,400 | A | * | 12/1998 | Takamoku | 29/894.354 |
| 5,983,496 | A | * | 11/1999 | Hermanson | 29/890.15 |
| 6,289,706 | B1 | * | 9/2001 | Hermanson | 72/82 |
| 6,991,298 | B2 | * | 1/2006 | Ording et al. | 301/30 |
| 7,082,796 | B1 | * | 8/2006 | Hermanson | 72/85 |
| 7,439,431 | B2 | * | 10/2008 | Jakonczuk | 84/413 |
| 7,498,496 | B2 | * | 3/2009 | Meadors | 84/270 |
| 2005/0223870 | A1 | * | 10/2005 | Passafiume | 84/269 |
| 2012/0222537 | A1 | * | 9/2012 | Deering et al. | 84/270 |

* cited by examiner

TABLE 1

| | | Resonant Frequencies (Hz) | | | | |
|---|---|---|---|---|---|---|
| | | 1st | 2nd | 3rd | 4th | 5th |
| **Conventional tone ring** | | 334 | 418 | 1041 | 1160 | 1983 |
| **Novel tone ring** | | | | | | |
| Thickness (in.) | Height (in.) | | | | | |
| 0.125 | 1.0000 | 70 | 175 | 199 | 382 | 618 |
| | 1.1250 | 70 | 177 | 199 | 383 | 619 |
| | 1.1875 | 71 | 177 | 200 | 383 | 620 |
| | 1.2500 | 71 | 177 | 200 | 384 | 620 |
| | 1.3750 | 71 | 177 | 200 | 385 | 611 |
| 0.25 | 1.0000 | 143 | 310 | 403 | 772 | 1035 |
| | 1.1250 | 143 | 320 | 404 | 774 | 1072 |
| | 1.1875 | 143 | 323 | 405 | 775 | 1084 |
| | 1.1250 | 143 | 327 | 405 | 775 | 1095 |
| | 1.3750 | 144 | 331 | 406 | 777 | 1105 |
| 0.26 | 1.0000 | 149 | 319 | 420 | 804 | 1059 |
| | 1.1250 | 149 | 329 | 421 | 805 | 1098 |
| | 1.1875 | 149 | 333 | 421 | 807 | 1113 |
| | 1.1250 | 149 | 337 | 422 | 808 | 1124 |
| | 1.3750 | 149 | 342 | 422 | 809 | 1138 |
| 0.3 | 1.0000 | 172 | 351 | 487 | 931 | 1141 |
| | 1.1250 | 173 | 365 | 488 | 933 | 1196 |
| | 1.1875 | 173 | 370 | 488 | 933 | 1216 |
| | 1.2500 | 173 | 376 | 489 | 935 | 1234 |
| | 1.3750 | 173 | 383 | 490 | 937 | 1258 |

200

Fig. 7

VERTICAL SIDES BANJO TONE RING AND METHODS

BACKGROUND OF THE INVENTION

1. Field of the Invention

The present invention relates generally to banjo design, and, more specifically, to a tone ring that produces a better quality tones without unwanted overtones and harmonics.

2. Description of the Related Art

The invention described herein is directed at providing a solution to the problem of unwanted overtones and undesirable harmonics that are produced from the conventional tone ring in the banjo industry. The conventional angled tone ring design is hampered by the angle of the ring which suppresses frequency response and adds overtones or harmonics that get in the way producing unwanted sounds.

Since about 1930, one tone ring design has been the industry standard. All subsequent banjo tone quality has been judged using this tone ring. This standard is generally described as an angled tone ring because of an approximate 40-43 degree angle from vertical. In other words, the ring circle slants downward and inwardly from vertical.

Banjo designers and manufacturers have attempted unsuccessfully to suppress unwanted vibrations, overtones, and harmonics, from this standard in a variety of ways. Different designs have tried a wide variety of materials, clamps, and drums. Yet never have these undesired sounds been eliminated. This conventional brass tone ring has produced what is generally called "the classic" banjo sound. Therefore, banjo pickers know what the standard banjo sound is and compare all other sounds to it.

The focus of the industry on the standard tone ring for almost 100 years has created additional problems. The expense of making the standard has increased. Availability of brass has decreased. The number of available manufacturers has decreased. And with all quality banjos using the same tone ring, the sound quality is virtually indistinguishable among competitors.

The novel present invention of an unangled tone ring has virtually eliminated all the present sound quality and production problems. Therefore, it is the overall object of the present invention to provide a novel tone ring to provide a better tone quality, that is a better sound to the listener. Another object is to provide a tone ring that can be manufactured using a wide variety of materials to reduce manufacturing cost. Still another object is to provide a sound quality in a banjo that is pure, aesthetically pleasing, and that easily produces a high volume tone. Yet another objective is to provide a banjo that can be produced at a variety of prices to appeal to all banjo enthusiasts. And yet another objective is to provide multiple novel embodiments of the present invention, including novel methods of manufacture. To date, to the knowledge of the Applicants, no such banjo tone ring has been invented. No relevant prior art on tone rings has been found after extensive world-wide searching through databases, trade literature, and trade shows. The Applicants think the present invention overcomes a long-standing sound quality problem that no one had thought possible.

SUMMARY OF THE INVENTION

The present invention is a banjo tone ring with vertical sides as opposed to the angled design of conventional banjo tone rings. The present invention is a continuous circular ring of metal. The ring of the present invention also has specific width or thickness to height ratios and within specific weight ranges. It vibrates much freer and thus raises the quality of musical tones from the banjo to much higher aesthetic levels. This novel tone ring design has a preferred weight range between 26 oz. and 65 oz. The above-mentioned difficulties and problems are overcome by these unique design features of the present invention.

To the knowledge of the Applicants, nobody ever has experimented with this unique tone ring design until now These features produced unexpected and unanticipated results providing a remarkable improvement in banjo tone surpassing all previous tones from existing banjo tone rings.

This innovative ring design in a drum assembly provides a new banjo design that is less expensive to make, can be made on site, uses easily procured materials, and is easily fabricated. It has an unusual engineering advantage because the choice of materials is extensive, far beyond normal engineering choices. Ferrous or nonferrous metals can be used and still get great sounds from this tone ring design. For instance, if the present invention were made of aluminum, the song would be pleasing. However, if the angled tone ring of conventional design were made of aluminum, it would sound terrible. The present invention made of aluminum would sound much better because it produces clean tones. It suppresses noise and prevents unwanted harmonics and overtones.

To summarize, just some of the novel features include the unexpected multiple metals that can produce a much superior banjo sound, a wide range of dimensions and weights that produce the superior sound, and that all typical descriptive parameters are vastly improved. In addition, as a result of the novel design of the present invention, novel methods of manufacture can be used that conventional tone rings cannot use. These, and other, novel features and advantages of the present invention are set forth more completely in the accompanying drawings and the following description.

BRIEF DESCRIPTION OF THE DRAWINGS

Details of the invention, and of the preferred embodiments thereof, will be further understood upon reference to the drawings, wherein closely related elements have the same number but different alphabetical suffixes, and further wherein:

FIG. 7 depicts Table 1 which is a chart illustration of the first five (5) resonant frequencies, called harmonics, of each configuration that was subjected to frequency analysis for a conventional tone ring compared to the present invention.

DETAILED DESCRIPTION OF THE PREFERRED EMBODIMENTS

The above-mentioned difficulties and problems are overcome by the present invention. The present invention of a vertical sides banjo tone ring is intended to be installed in a banjo. The vertical sides are completely different from the angled design of conventional banjo tone rings. The banjo tone ring is comprised of a continuous circular ring of metal, wherein said ring has vertical sides. It vibrates much freer and thus raises the quality of musical tones from the banjo to much higher aesthetic levels.

Applicants have received many rave reviews about how extraordinary the banjo sounds. Tone rings that are physically lighter, that is, weigh less, produce less sustain which is most desirable for old time banjo music. Heavier tone rings produce more sustain which is better for bluegrass music. This novel tone ring design of the present invention also has specific width or thickness to height ratios. Additionally, the banjo ring is within specific weight ranges wherein a weight of said ring is preferably 26-65 ounces, or more preferably 30-40 ounces, or most preferably 36.33-38.33 ounces. Therefore, with the present invention, a banjo is tailored for an individual banjo player's needs.

This innovative ring design in a drum assembly provides a new banjo design that is less expensive to make, can be made on site, uses easily procured materials, and is easily fabricated. It has an unusual engineering advantage because the choice of materials is extensive, far beyond normal engineering choices. Ferrous or nonferrous metals can be used and still get a great sound from this tone ring design. Whereas if the angled tone ring of conventional design were made of aluminum, it would sound terrible. The present invention made of aluminum would sound much better because it produces clean tones. It suppresses noise and prevents unwanted harmonics and overtones.

The traditional or conventional angled tone ring suppresses free vibration by its angle and also creates unwanted vibrations and overtones. The improvement in tone is measured on electronic recording studio digital equipment by the actual readings. The sound flows freely from this design such that the sound carries much farther and sounds much more beautiful than the conventional angled tone ring. Children even run over to hear it because it has a tremendous dynamic range that is sweet and warm when played quietly and, when played strongly, it rings louder than conventional tone rings.

In addition, as a result of the novel design of the present invention, novel methods of manufacture can be used that conventional tone rings cannot use. The preferred method of manufacture and alternative methods are described after the apparatus description in FIGS. 1 through 7.

Figure 1:
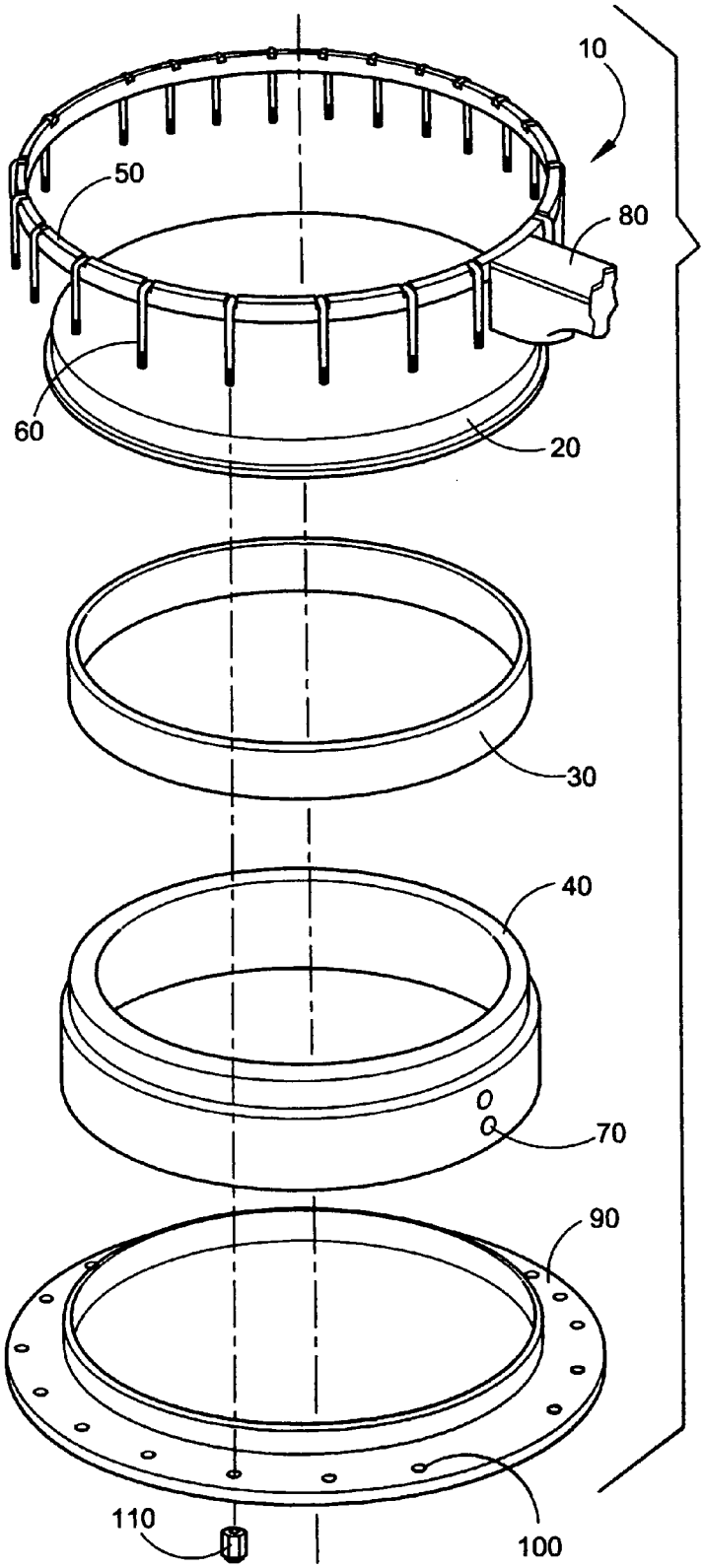
FIG. 1 is an exploded assembly view of a portion of a banjo including the present invention tone ring.

Referring first to FIG. 1, an exploded assembly view of a portion of a banjo (10) is shown. Generally, the assembly of a banjo (10) follows the following major steps. First, a skin (20) is laid over a vertical sides tone ring (30) which is slipped over a wooden drum (40). Then, a tension hoop (50) is slipped over the skin (20) and tone ring (30). Next, numerous metal connectors called hooks (60) are spaced around the tension hoop (50) and snapped over the tension hoop (50). The tension hoop (50) is then slipped over the wooden drum (40). removably attached to the wooden drum (40), using the hooks (60). Next, the wooden drum (40) is removably attached to a banjo neck (80), through drum holes (70), typically with a plurality of nuts and bolts (not shown). These bolts pass through the wooden drum (40). Finally, the wooden drum (40) is slipped over a flange (90) and the hooks (60) are removably attached to the flange (90) through flange holes (100) with a plurality of flange nuts (110).

Figure 2:
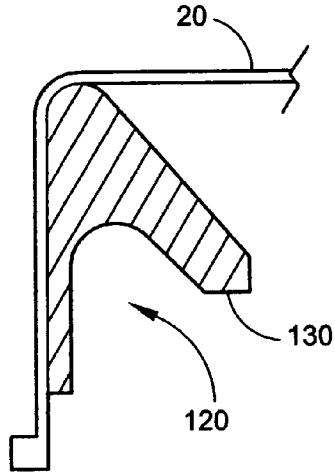
PRIOR ART Fig. 2
FIG. 2 is a section view of a conventional tone ring.

Next, in FIG. 2 is shown a section view of a conventional angled tone ring (120). An angled portion (130) of the conventional tone ring (120) is shown. Note the dramatic difference between the angled portion (130) and the present invention tone ring (30) of FIG. 1 with vertical sides. One immediately sees the stark manufacturing difference of a more complicated design of the current industry standard compared to the present invention. Also illustrated is the skin (20) stretched over the angled tone ring (120) in a similar way as describe in FIG. 1.

Figure 3:
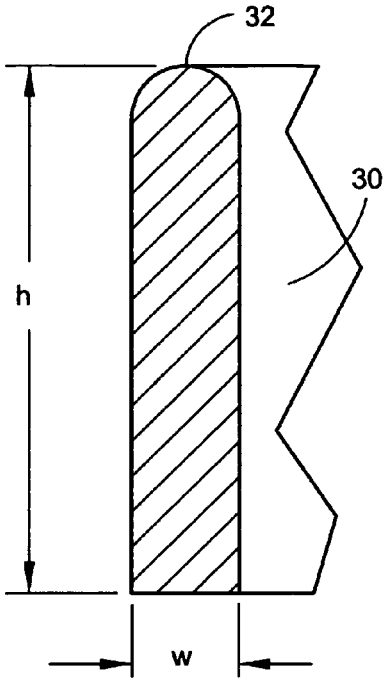
FIG. 3 is a section elevation view of the present invention.

Now shown in FIG. 3 is a section elevation view of the present invention. The tone ring (30) is dimensioned with height (h) and width (w). These dimensions are variable, yet within specific ranges as discussed later in Table 1 (200). A top portion (32) of the tone ring (30) is also indicated. A variety of metals have been tested and have proven to be excellent choices when parameters are compared to the industry standard tone ring. The present invention banjo tone ring (30) may be brass, or, alternatively, aluminum, or, alternatively, steel, or, alternatively, iron, or alternatively, other ferrous or nonferrous materials may be used.

Figure 4:
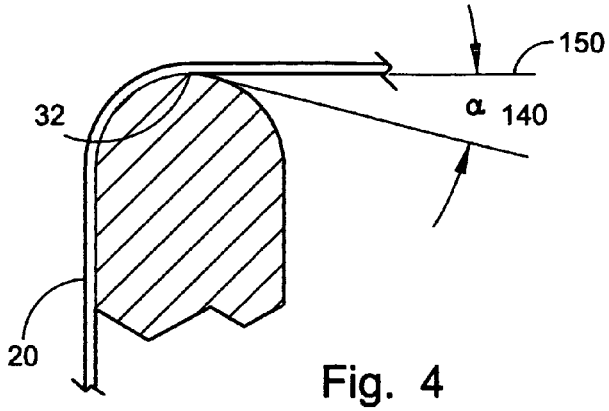
FIG. 4 is an enlarged top portion of the section view of FIG. 3 of the present invention.

Next is shown a FIG. 4 of the enlarged top portion (32) of the section view of FIG. 3 of the present invention. The skin (20) is again shown stretched over the top portion (32). Note that an angle alpha (140) is made with a horizontal plane (150) of skin (20). The angle alpha (140) represents an angle (140) that allows restricted air movement when the skin (20) vibrates because of plucking of banjo strings (not shown) of the banjo (10). The space between the top portion (32) and the horizontal plane (150) is so constricted that undesired damping of sound occurs.

Figure 5:
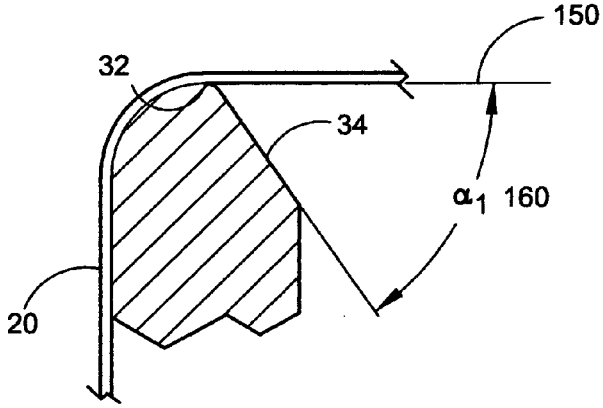
FIG. 5 is a truncated enlarged top portion of the section view of FIG. 3 of the present invention.

Shown next in FIG. 5 is a truncated face (34) of enlarged top portion (32) of the section view of FIG. 3 of the present invention. The truncated face (34) is shown of the top portion (32). An angle alpha 1 (160) represents a minimum angle between the horizontal plane (150) and the top portion (32). This angle alpha 1 (160) represents the least or minimum angle that prevents any dampening of sound when the skin (20) vibrates. The unexpected result of this embodiment is that the sound of the banjo (10) with the truncated face (34) is freer than the original banjo sound with the conventional tone ring (120). So the present invention of the vertical sides tone ring (30) with a truncated face (34) creates a different sound. In other words, the novel banjo ring (30) has a top (32) of said ring (30) truncated to create a minimum angle (160) from a horizontal plane (150) tangent to said top (32) of said tone ring (30), and further wherein said minimum angle (160) prevents a banjo skin (20) from physically touching said top (32) of said tone ring (30) while said skin (20) vibrates.

Figure 6:
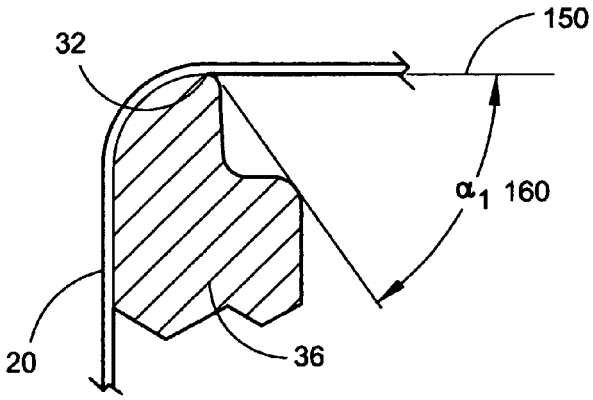
FIG. 6 is an enlarged modified top portion of a section elevation view of the present invention.

Now shown in FIG. 6 is an enlarged modified top portion (36) of a section elevation view of the present invention. This additional embodiment demonstrates that variations in physical dimensions may be made in the top portion (32) of the tone ring (30) of the present invention without altering the sound created with a truncated face (34). Angle alpha 1 (160) is the same minimum angle as described in FIG. 5. Therefore, the different sound created with a truncated face (34) is duplicated in FIG. 6 with the modified top portion (36). In other words, the novel banjo ring (30) has said top (32) of said tone ring (30) modified to create a minimum angle (160) from a horizontal plane (150) tangent to said top (32) of said tone ring (30), and further wherein said minimum angle (160) prevents a banjo skin (20) from physically touching said top (32) of said tone ring (30) while said skin (20) vibrates.

Finally in FIG. 7 there is shown Table 1 (200) that illustrates a chart of the first five (5) resonant frequencies, called harmonics, of each configuration that was subjected to frequency analysis for a conventional tone ring (120) compared to the novel tone ring (30) of the present invention.

The objective of mathematical statistical analysis is to compare fundamental frequencies of the present invention tone ring (30) to those of a more conventional tone ring (120) design. The methodology uses 3-dimensional CAD models of all configurations generated using Solidworks. The conventional tone ring (120) is modeled by revolving a cross-section 360 degrees around an axis. All linear dimensions are given in inches, while angular dimensions are in degrees.

The present invention tone ring (30) is modeled by revolving a cross-section 360 degrees around an axis. Note that the '0.26' and '1.25' dimensions of the present invention are varied throughout the study to examine effects on resonant frequencies. Two solid models, a conventional tone ring (120), and the present invention tone ring (30), are assigned the material properties of brass with Young's modulus=1.45 e7 psi, Poisson's ratio=0.33, density=0.307 lb/in^3. The properties are examined using the frequency analysis module of CosmosWorks, the Finite Element Analysis package incorporated into Solidworks.

Displacement and deformation plots are generated for the first five (5) resonant frequencies, also called $1^{st}$ through $5^{th}$ harmonics, for each configuration tested. Then the numerical values of these resonant frequencies are recorded. Table 1 (200) presents the first five (5) resonant frequencies of each configuration subjected to frequency analysis. The present invention tone ring (30) shifts the fundamental frequency down significantly as compared to the conventional tone ring (120). Within the various configurations of the present invention tone ring (30), varying the thickness or width (w) has much more of an effect on the resonance frequencies than varying the height (h) does. Engineering study results conclusively show a lower vibrating frequency producing a sweeter tone.

Other analyses show that the traditional tone ring (120) vibrates at a higher frequency. A profile spectrum of numerous frequency ranges, widths and heights and weights yields a preferred width or thickness to height ratio. Said ring (30) is preferably of a width to height ratio of 0.125 to 0.3 inch wide and 1.0000 to 1.3750 inches high. Said ring (30) is more preferably of a width to height ratio of 0.125 inch wide to 1.0000-1.3750 inches high. Said ring (30) is most preferably of a width to height ratio of 0.25 inch wide to 1.1875 inches high. This most preferable width to height ratio vibrates at less than half the frequency of the traditional tone ring (120) yet has the same mass as the traditional tone ring (120) which results in both louder and sweeter tone. Nevertheless, all of the width or thickness to height ratios are dramatically lower, that means better, than the conventional tone ring (120) as shown in Table 1 (200).

Note each of the parameters and the remarkable improved decrease or increase in the specific parameters. Harmonics are known to interfere with sound quality. In fact, harmonics are quite destructive to the human hearing, or even metal bridges! Clearly, novel improvements are made with this radically novel banjo tone ring (30).

Several novel embodiments of manufacturing methods are now described. One method of manufacturing a vertical sides tone ring (30) preferably comprises the steps of:

obtaining a suitable off the shelf bar stock material, measuring said bar stock to a desired length and width (w) of an outside diameter and height (h) of said tone ring (30), cutting said bar stock to an approximate desired length and height (h), rolling said bar stock into a circular form, re-measuring said circular form for accurate diameter and height (h), machining said form to tolerance of preferred diameter and height (h), butt welding two opposing ends of said form into a one piece ring, and polishing said form into said vertical sides tone ring (30), thereby providing a quick efficient fabrication of said tone ring (30), in-house on simple equipment with minimal waste.

A second method of manufacturing a vertical sides tone ring (30) alternatively comprises the steps of:

obtaining a suitable bar stock material, measuring said bar stock to a desired length and width (w) of an outside diameter and height (h) of said tone ring (30), cutting said bar stock to an approximate desired length and height (h), rolling said bar stock into a spiral, cutting said spiral into four parts, re-measuring said four parts for accurate diameters, machining said parts to tolerance of preferred diameters, butt welding opposing ends of said parts into four rings, and polishing said parts into four identical vertical sides tone rings (30), thereby providing a very efficient process and resulting in a tone ring of superior sound quality produced at a fraction of the cost of a conventional tone ring (120).

Still a third embodiment of a method of manufacturing a vertical sides tone ring (30) alternatively comprises the step of:

brazing opposing ends of said parts into a one piece tone ring.

Yet a fourth embodiment of a method of manufacturing a vertical sides tone ring (30) alternatively comprises the step of:

soldering opposing ends of said parts into a one piece tone ring.

A fifth embodiment of a method of manufacturing a vertical sides tone ring (30) alternatively comprises the steps of:

creating a mold of said vertical sides tone ring (30), selecting a metallic bar stock, melting an appropriate quantity of said bar stock for a desired weight of said tone ring (30) into molten metal, pouring said molten metal into a bucket, casting said molten metal from said bucket into said mold, cooling said molten metal in said mold, removing said metal, now in a ring shape, from said mold, checking dimensions of said ring (30), and machining said ring to tolerance, wherein said casting may alternatively be sand casting, centrifugal casting, continuous casting, investment casting, die casting, or other appropriate casting method.

The novel vertical sides banjo tone ring (30) has a simple profile, and therefore has the advantage of being amenable to casting to almost final dimensions. Therefore, almost no extra material, and almost no waste material is experienced in final machining. Whereas, the conventional tone ring (120) does not have a simple profile. Therefore, the conventional ring (120) requires much extra material in the casting to allow for the machining of the part that results in a great deal of waste.

Yet a sixth embodiment of a method of manufacturing a vertical sides tone ring (30) alternatively comprises the steps of:

obtaining a length of an appropriate alloy of metallic pipe or tubing precut to a desired outside diameter and height (h) of said tone ring (30), and polishing said pipe into said vertical sides tone ring (30), thereby resulting in a very efficient fabrication. Virtually any alloy of metallic pipe or tubing can be used. As a result of the novel vertical sides tone ring (30) design, it provides unexpected variety in materials that can be used to produce a superior sound quality.

Still a seventh embodiment of a method of manufacturing a vertical sides tone ring (30) alternatively comprises the steps of:

creating a mold of said vertical sides tone ring (30),
selecting a metal,
obtaining a pre-determined powdered quantity of said metal for a desired weight of said tone ring (30),
mixing said powdered metal with an appropriate quantity of binding agent in a sintered metal process, and
heating and applying pressure to said metal and binding agent until one piece of metal is joined.

The novel vertical sides tone ring (30) allows for novel manufacturing embodiments because many different casting methods can be used as described above.

Another and eighth embodiment of a method of manufacturing a vertical sides tone ring (30) alternatively comprises the steps of:
creating a mold of said vertical sides tone ring (30),
selecting a metal,
obtaining a pre-determined powdered quantity of said metal for a desired weight of said tone ring (30) in a powdered metal process,
adding appropriate binding agents, and
applying appropriate pressure, or alternatively heat, to said metal until binding is complete and said metal is one piece of metal.

A ninth embodiment of a method of manufacturing a vertical sides tone ring (30) alternatively comprises the step of obtaining suitable bar stock that may be iron, steel, stainless steel, brass, bronze, aluminum, magnesium, zinc, tin, copper, silver, or gold.

Yet a tenth embodiment of a method of manufacturing a vertical sides tone ring (30) alternatively comprises the step of casting suitable bar stock using casting alloys of iron, steel, stainless steel, brass, bronze, aluminum, magnesium, zinc, tin, copper, silver, or gold.

The novel shape of the vertical sides tone ring (30) has the characteristic of a unique vibrating quality. Therefore, many different alloys can be used to die cast the ring (30). A conventional tone ring (120) must use alloys that melt at too high a temperature to be die cast, or if attempted, produce a poor sound quality An eleventh embodiment of a method of manufacturing a vertical sides tone ring (30) includes brass alloy of 360 brass with a melting point of 1650 degrees F. using an appropriate mold material that withstands said degrees.

A twelfth embodiment of a method of manufacturing a vertical sides tone ring (30) includes a brass alloy used in die casting composed of a lean alloy mixture, wherein said melting temperature of said brass alloy is lower than alloys used in a conventional tone ring (120), whereby the sound quality of said vertical sides tone ring (30) is improved compared to said conventional tone ring (120).

Consequently, while the foregoing description has described the principle and operation of the present invention in accordance with the provisions of the patent statutes, it should be understood that the invention may be practiced otherwise as illustrated and described above and that various changes in the size, shape, and materials, as well as on the details of the illustrated construction may be made, within the scope of the appended claims without departing from the spirit and scope of the invention.

What is claimed is:

1. A banjo body construction having a tone ring (30) comprising a continuous circular ring of metal, wherein said ring has vertical sides;
and further wherein said banjo body construction comprises an annular step of rectangular cross section corresponding to the inner diameter of said tone ring, where the bottom of said tone ring rests on the ledge and inner wall of said tone ring faces the annular cross section and the interface lacks through holes or fasteners, but said tone ring is held to the drum by the tension on the banjo head, where tension on the banjo head is provided by fasteners between a tension hoop (50) slipped over the banjo skin and a flange (90) slipped onto the wooden drum.

2. The banjo body construction having a tone ring (30) according to claim 1, wherein said metal is brass,
or, alternatively, aluminum,
or, alternatively, steel,
or, alternatively, iron
or, alternatively, other ferrous or nonferrous materials.

3. The banjo body construction having a tone ring (30) according to claim 1, wherein a weight of said ring is preferably 26-65 ounces.

4. The banjo body construction having a tone ring (30) according to claim 1, wherein a weight of said ring is more preferably 30-40 ounces.

5. The banjo body construction having a tone ring (30) according to claim 1, wherein a weight of said ring is most preferably 36.33-38.33 ounces.

6. The banjo body construction having a tone ring (30) according to claim 1, wherein said ring (30) is preferably of a width (w) to height (h) ratio 0.125 to 0.3 inch wide to 1.0000 to 1.3750 inches high.

7. The banjo body construction having a tone ring (30) according to claim 1, wherein said ring (30) is more preferably of a width (w) to height (h) ratio of 0.125 inch wide to 1.0000 to 1.3750 inches high.

8. The banjo body construction having a tone ring (30) according to claim 1, wherein said ring (30) is most preferably of a width (w) to height (h) ratio of 0.125 inch wide to 1.1875 inches high.

9. The banjo body construction having a tone ring (30) according to claim 1, wherein a top (32) of said ring (32) is truncated to create a minimum angle (160) from a horizontal plane (150) tangent to said top (32) of said tone ring (30).

10. The banjo body construction having a tone ring (30) according to claim 9, wherein said top (32) of said tone ring (30) is modified to create a minimum angle (160) from a horizontal plane (150) tangent to said top (32) of said tone ring (30), and further wherein said minim angle (160) prevents a banjo skin (20) from physically touching said top (32) of said tone ring (30) while said skin (20) vibrates.

* * * * *